United States Patent [19]

Chaplin et al.

[11] Patent Number: 4,714,443

[45] Date of Patent: Dec. 22, 1987

[54] FLEXIBLE EXHAUST DUCT

[75] Inventors: John B. Chaplin, Edgewater, Md.; Charles S. Whipple, Slidell, La.

[73] Assignee: Textron Inc., Providence, R.I.

[21] Appl. No.: 898,352

[22] Filed: Aug. 20, 1986

[51] Int. Cl.[4] ..... B63H 21/32

[52] U.S. Cl. ..... 440/89; 114/67 A; 180/117; 180/120; 180/126; 181/235; 60/272

[58] Field of Search ..... 114/61, 67 A; 440/88, 440/89; 239/533.1, DIG. 12; 60/272, 322, 310; 181/241, 247, 271, 246, 235; 180/116, 120, 126, 117

[56] References Cited

U.S. PATENT DOCUMENTS

| | | | |
|---|---|---|---|
| 987,130 | 3/1911 | Geyer | 440/89 |
| 1,031,943 | 7/1912 | Lloyd-Horry | 181/271 |
| 1,198,274 | 9/1916 | Reece | 440/89 |
| 2,522,883 | 9/1950 | MacArthur | 440/89 |
| 2,859,830 | 11/1958 | Hoffar | 181/271 |
| 3,084,651 | 4/1963 | Parmenter | 114/67 R |
| 3,568,672 | 3/1971 | Cupp | 128/142 |
| 3,907,061 | 9/1975 | Chapman et al. | 114/67 A |
| 4,533,095 | 8/1985 | Yates | 244/23 D |

FOREIGN PATENT DOCUMENTS

| | | | |
|---|---|---|---|
| 0059096 | 5/1980 | Japan | 440/89 |
| 0182596 | 11/1982 | Japan | 440/89 |

*Primary Examiner*—Jeffrey V. Nase
*Assistant Examiner*—Edwin L. Swinehart
*Attorney, Agent, or Firm*—Bean, Kauffman & Bean

[57] ABSTRACT

A novel exhaust system for both conducting engine exhaust gases away from and aft of the personnel occupied portion of a marine vessel and protecting the sides of the hull of the vessel from damages thereto during docking or other "working" maneuvers of the vessel is provided.

6 Claims, 4 Drawing Figures

FLEXIBLE EXHAUST DUCT

BACKGROUND AND OBJECTS OF THE INVENTION

It is well known that marine vessel internal combustion engine exhausts may be beneficially discharged underwater for above water sound suppression purposes. Also, it is well known that marine vessels employ "fender" means for their protection against hull damage or the like when docking, and/or when coming into contact with other vessels.

However, an object of the present invention is to provide an improved single means for both conducting the engine exhaust discharge of vessels of the "SES" (Surface Effect Ship) type away from and aft of the personnel occupied portion of the vessel; as well as for protecting the hull from damages thereto during docking or other "working" maneuvers of such vessels. Furthermore, the engine exhaust system of the present invention provides means which automatically, beneficially regulates the cross sectional area of the engine exhaust system in response to alternative "on cushion" and "off cushion" operations of the vessel and the extent of conduit inflation. Whether the ship is patrolling "on cushion" or is "off cushion" with engines running, the previously encountered engine exhaust noise is reduced without requiring use of conventional type mufflers or the like; thereby effecting cost and weight reductions and contributing substantially to the comfort of the passengers and operational efficiencies of the crew.

SUMMARY OF THE INVENTION

The present invention provides an efficiently operative and inexpensively fabricated and maintainable engine exhaust conveying system which includes a pair of flexible/inflatable conduits attached to and extending outside of and in fore/aft direction along opposite sides of the ship hull. The conduits are arranged in open communication with the ship's engine exhaust outlets, and extend therefrom rearwardly and slightly downwardly and terminate open-endedly to discharge the engine exhausts at least partially underwater at the aft end of the ship when the ship is "off cushion" such as when docking or otherwise maneuvering. Thus, under such circumstances the exhausts are sound-wise muffled vis-a-vis the external environment as well as the passengers and ship crew.

During such maneuverings of the ship, its engines are typically "revved" up, thereby causing the flexible conduits of the invention to be inflated into pneumatic cushion-like form. Thus, means for "fendering" the ship against physical contact damage is automatically provided by means of the exhaust conduits of the invention. Also, the invention is uniquely beneficial when employed in a high speed SES type ship specifically designed for maintaining surveillance and apprehending vessels involved in illegal activities. Because of operating fuel costs and other practical considerations, the diesel type engine is typically preferred for providing the main power for such ships. However, when maintaining surveillance operations or the like, the engines are typically run at idling speeds for extended periods of time. Under such low power output conditions, the optimum exhaust outlet cross sectional area is less than that for high power output conditions. The present invention provides an automatically varying exhaust duct cross sectional area uniquely beneficial to the performance capabilities of diesel engine powered ships designed for such as the above mentioned purposes.

The flexible conduits terminate at their rear ends in open-ended nozzle portions which are directed rearwardly and downwardly so as to straddle the "off cushion" water line alongside the stern end of the vessel. Thus, the gases and reverberating sound waves of the engine exhausts are released below and behind the crew and passenger quarters of the vessel, and the external noise level of the engine exhaust is variously reduced according to the loading of the vessel and the ambient wave profiles. Whereas the drawings herewith show the invention as embodied only in a SES (Surface Effect Ship) type vessel, it will be understood that it may also be applicable to other high speed type marine vessels such as planing boats or the like.

BRIEF DESCRIPTION OF THE DRAWING

The drawing herewith illustrates the preferred mode of practice of the invention, wherein.

DETAILED DESCRIPTION

Figure 1:
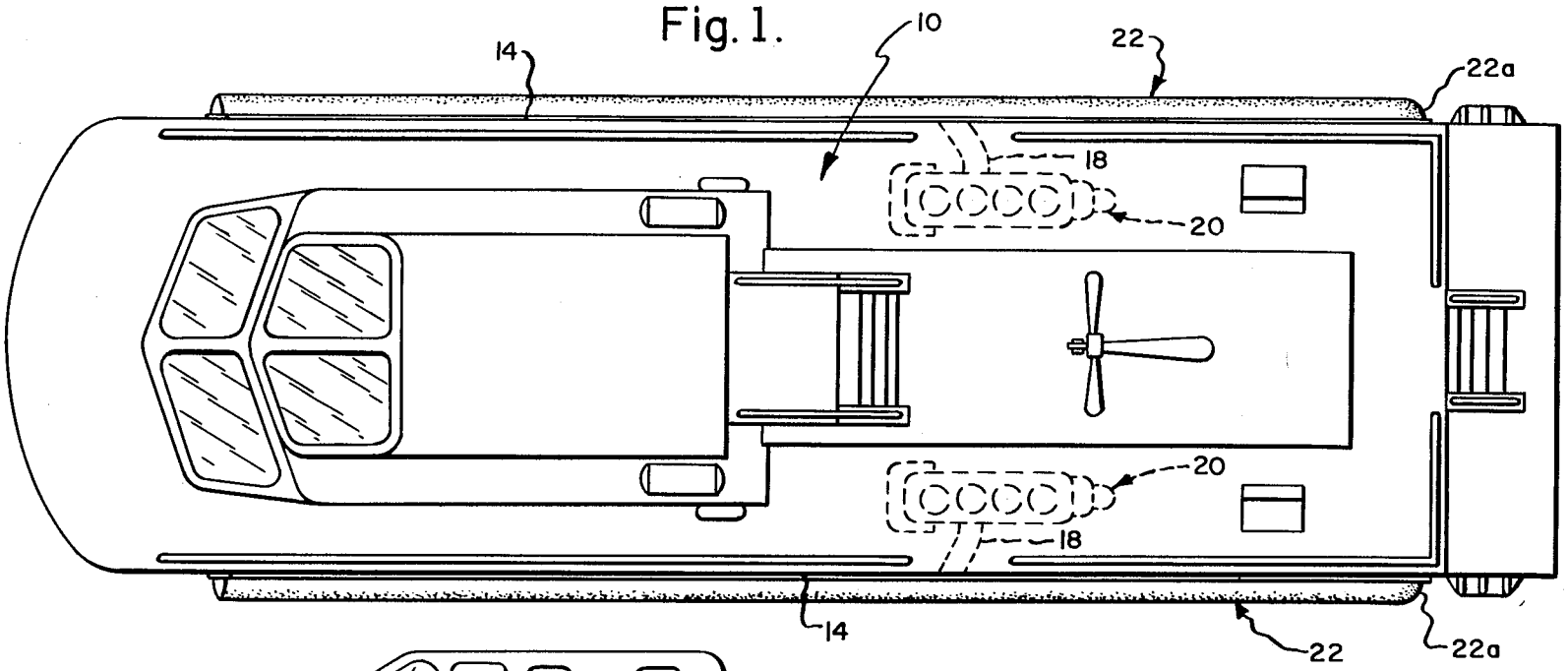
FIG. 1 is a plan view of a marine vessel of an otherwise conventional SES type, embodying the invention.
Figure 2:
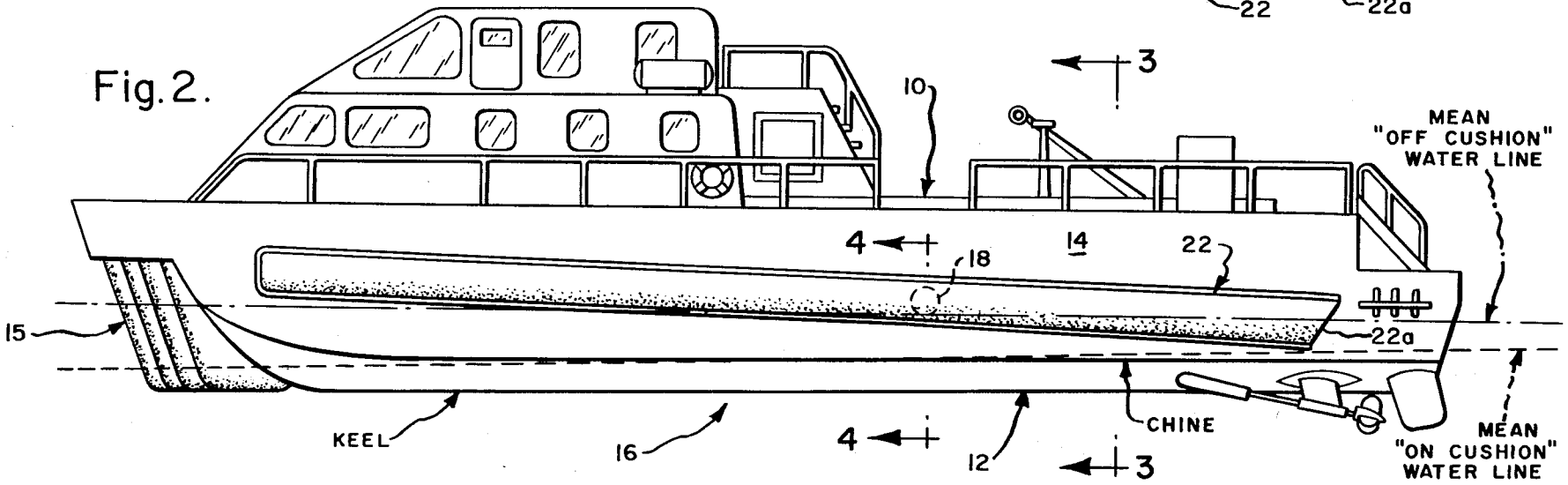
FIG. 2 is a side elevational view thereof.
Figure 3:
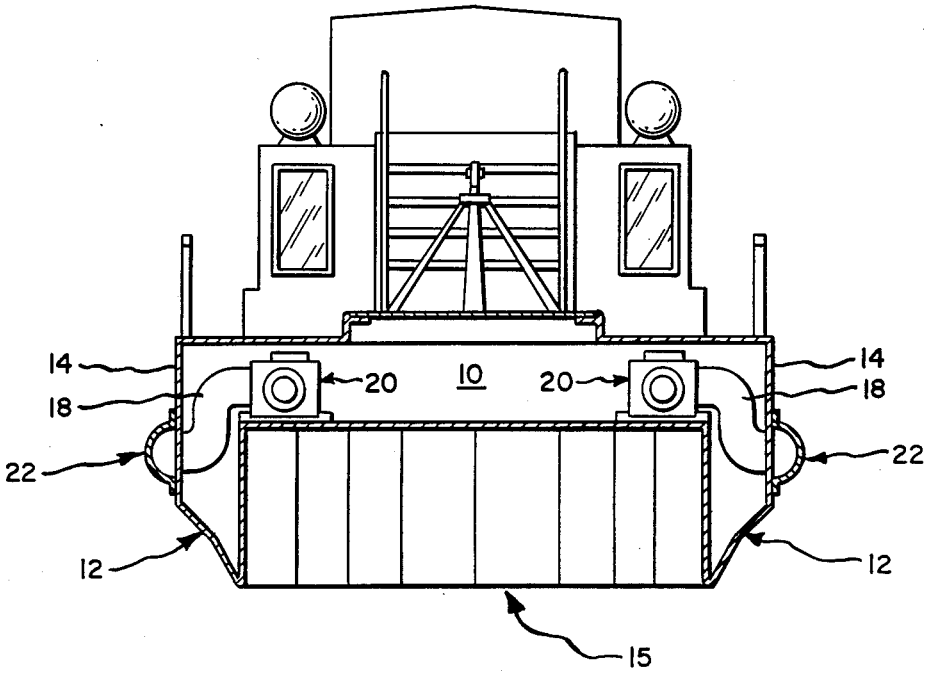
FIG. 3 is a vertical sectional view taken as along line 3—3 of FIG. 2.

As illustrated herein, this invention is especially designed for embodiment in SES type marine vessels such as basically comprise a main hull 10 supporting thereabove a crew and passenger accommodating deck and from which depend at opposite longitudinal sides thereof so-called side hulls 12,12 which are of hollow box-like sectional form having outside panels or oppositely facing hull sides 14,14 as best shown at FIG. 3. The main and side hull structures are water-sealed and provide buoyant support for the vessel when in an off cushion situation. However, as is conventional in the art, the "air cushion" space between the side hulls 12,12 closed at the bow and stern ends of the ship by means of flexible seals for cooperation with pressurized air supply means providing a transient air cushion for elevating the main hull to levels above the water surface when the ship is operating in "on cushion" mode. A flexible bow seal arrangement is shown herein at 15 (FIGS. 2 and 3); and it is to be understood that a typical stern seal of an suitable type (not shown) will also be employed. As shown in the drawing herewith by way of example, in the case of the present invention the ship's engine's exhaust system may include a pair of ducts 18,18 leading from the ship's engines 20,20, and discharging through the hull sides 14,14 of the side hulls into flexible/inflatable exhaust conduits 22,22, which extend substantially coextensive with the hull sides in a direction extending lengthwise of the vessel and have rearwardly opening nozzles *22a,22a* for directing engine exhaust rearwardly of the vessel, as shown in FIGS. 1 and 2. However, it is to be understood that the ship's power plant may comprise any other number of engines, whereby the exhaust ducting system would be appropriately modified.

Figure 4:
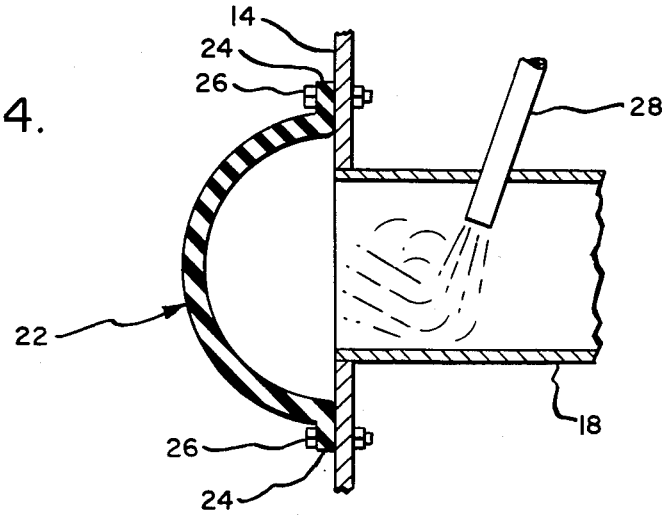
FIG. 4 is an enlarged scale fragmentary sectional view, taken as along line 4—4 of FIG. 2.

The conduits 22,22 may be manufactured of any suitable gas-impermeable, strong but flexible, sheet-like material; such as for example a rubberized or other elastomer coated woven fabric or the like. The material should, of course, also be suitably resistant to sea water and engine exhaust chemical content, as well as to the engine exhaust temperatures. As best shown at FIGS. 3 and 4, the conduits are of semi-circular sectional form terminating along their upper and lower edges and at their forward ends in means for attaching them to the hull sides 14,14. Thus, by way of example as shown at 24 (FIG. 4), the conduits may be flanged and detachedly mounted against the hull sides 14,14 by means of bolts or the like as shown at 26. Also, as shown at FIG. 4, the spent engine cylinder cooling water may be beneficially discharged such as through pipes 28 into the engine exhaust ducts 18,18 ahead of discharge into the flexible/inflatable conduits 22,22. Thus, the structures at the juncture of the ducts and the conduits as well as the fabrics of the conduits 22,22 are provided important protection from otherwise damaging high temperatures.

In the example shown at FIGS. 1 and 3 of the drawing herewith, the ship's power plant comprises a pair of diesel engines located at opposite sides and midship of the vessel; and the exhaust ducts 18,18 from the engines are conveniently arranged to deliver into the conduits 22,22 approximately midway of their lengths alongside the ship. In lieu of such an arrangement, the exhaust duct system may be provided to discharge into the conduits at any other positions lengthwise thereof; but in any case at least the aft ends of the conduits 22,22 are to be mounted on the side hulls so as to incline downwardly so as to be at their discharge nozzles *22a,22a* partially above and partially below the "off cushion" hullborne water line of the vessel. Thus, when the engines are operating with the vessel "off cushion" the external engine exhaust noise is thereby substantially reduced, and the exhaust duct cross section is automatically reduced to better match the low power output of the engines. This is also an important feature of the present invention and the degree of back pressure may of course be regulated by appropriate sizing of the conduit exhaust nozzles.

The operating hull water lines of vessels of this type will of course vary according to the loading of the vessel, and the operating levels of the discharge nozzles of the conduits 22,22 relative to the water surface will also vary substantially according to the pattern of the bow induced waves when the vessel is moving. However, there is in any case provided by means of the present invention an inexpensively manufactured, lightweight and readily replaceable engine exhaust conduit system which is peculiarly adapted to surface effect ships which alternatively operate "on" and "off cushion". The environment is acoustically benefited to the advantage of passenger and bystanding and crew personnel. When the engine(s) are operating, the inflated exhaust conduits provide fendering means in the form of pneumatic cushion-like bumpers for protecting the vessel hull sides against structural damage, and it is noteworthy that the conduits 22,22 are less susceptible to damage such as would be experienced by rigidly structured external engine exhaust conduits when the ship is subjected to docking and/or other such type collision accidents. And in addition, the engine exhaust conveying system of the present invention automatically provides duct area variations which are especially beneficial to the operating characteristics of internal combustion engines of the diesel type when operating alternately at idling and higher speeds.

What is claimed is:

1. In a marine vessel having oppositely facing hull sides and powered by internal combustion engine means, the improvement comprising:

exhaust ducts connected to said engine means for conveying engine exhaust therefrom outwardly through openings provided in each of said hull sides; and elongated exhaust conduits mounted on each of said hull sides in flow communication with said openings, said exhaust conduits extending substantially coextensive with said hull sides in a direction lengthwise of said vessel and having rearwardly opening nozzles for directing said engine exhaust from said engine means rearwardly of said vessel, and said exhaust conduits are arranged and formed of a flexible and inflatable material inflatable in response to the pressures of said engine exhaust to provide deformable pneumatic cushion-like bumpers for protecting said hull sides.

2. The improvement according to claim 1, wherein said exhaust conduits are formed as elongated strips of sheet material fixed to said hull sides along opposite side edges and forward end edges thereof, and aft end edges of said strips cooperate with said hull sides to define said nozzles.

3. The improvement according to claim 1, wherein said vessel is of the type adapted to travel alternatively in a water surface skimming or planing mode and a hull partially submerged or displacement mode, and said exhaust conduits have at least the aft ends thereof arranged to incline downwardly for positioning said nozzles partially above and partially below a water line of said vessel when in said hull partially submerged mode.

4. The improvement according to claim 3, wherein said exhaust conduits are formed as elongated strips of sheet material fixed to said hull sides along opposite side edges and forward end edges thereof, and aft end edges of said strips cooperate with said hull sides to define said nozzles.

5. The improvement according to claim 4, wherein said exhaust conduits expand upon inflation into a semicircular cross-sectional form.

6. The improvement according to claim 5, wherein said exhaust conduits incline downwardly throughout the lengths thereof.

* * * * *